US009454932B2

(12) United States Patent
Ono et al.

(10) Patent No.: US 9,454,932 B2
(45) Date of Patent: Sep. 27, 2016

(54) DISPLAY DEVICE AND METHOD OF CONTROLLING THE SAME

(75) Inventors: Shinya Ono, Osaka (JP); Arinobu Kanegae, Osaka (JP); Hitoshi Tsuge, Osaka (JP); Kouhei Ebisuno, Kyoto (JP)

(73) Assignee: JOLED INC., Tokyo (JP)

( * ) Notice: Subject to any disclaimer, the term of this patent is extended or adjusted under 35 U.S.C. 154(b) by 58 days.

(21) Appl. No.: 14/359,975

(22) PCT Filed: Nov. 24, 2011

(86) PCT No.: PCT/JP2011/006543

§ 371 (c)(1),
(2), (4) Date: May 22, 2014

(87) PCT Pub. No.: WO2013/076772

PCT Pub. Date: May 30, 2013

(65) Prior Publication Data

US 2014/0313241 A1 Oct. 23, 2014

(51) Int. Cl.

| | |
|---|---|
| ***G09G 5/10*** | (2006.01) |
| ***G09G 3/32*** | (2016.01) |
| ***G09G 3/36*** | (2006.01) |

(52) U.S. Cl.

CPC ..... *G09G 3/3258* (2013.01); *G09G 3/3233* (2013.01); *G09G 3/3659* (2013.01); (Continued)

(58) Field of Classification Search

CPC ..... G09G 3/3233; G09G 3/3659; G09G 3/3258; G09G 2300/0819; G09G 2300/0852; G09G 2300/0861; G09G 2300/0876; G09G 2320/0233; G09G 2320/043; G09G 2300/0809; G09G 2310/0294

USPC ..... 345/77

See application file for complete search history.

(56) References Cited

U.S. PATENT DOCUMENTS

| | | | |
|---|---|---|---|
| 7,329,849 | B2 | 2/2008 | Kasai |
| 7,397,447 | B2 | 7/2008 | Matsumoto |

(Continued)

FOREIGN PATENT DOCUMENTS

| | | |
|---|---|---|
| CN | 1541033 | 10/2004 |
| CN | 101071217 | 11/2007 |

(Continued)

OTHER PUBLICATIONS

Search report from PCT/JP2011/006543, mail date is Feb. 21, 2012.

(Continued)

*Primary Examiner* — Towfiq Elahi

(74) *Attorney, Agent, or Firm* — Greenblum & Bernstein, P.L.C.

(57) ABSTRACT

Pixel circuits of a display device each include: a drive transistor including one of a source and drain connected to a power source line; a capacitive element including a first terminal connected to a gate of the drive transistor; a switching element which switches conduction/non-conduction between a second terminal of the capacitive element and a data line; a switching element which switches conduction/non-conduction between the second terminal of the capacitive element and the source of the drive transistor; a switching element which switches conduction/non-conduction between the first terminal of the capacitive element and a reference voltage line; a light-emitting element including a first terminal connected to the other of the source and drain of the drive transistor and a second terminal connected to another power source line. The reference voltage line provides a forward bias voltage larger than a threshold voltage across the gate and source of the drive transistor.

12 Claims, 13 Drawing Sheets

(52) U.S. Cl.
CPC ..... *G09G2300/0439* (2013.01); *G09G 2300/0809* (2013.01); *G09G 2300/0819* (2013.01); *G09G 2300/0852* (2013.01); *G09G 2300/0861* (2013.01); *G09G 2300/0876* (2013.01); *G09G 2310/0294* (2013.01); *G09G 2320/0223* (2013.01); *G09G 2320/0233* (2013.01); *G09G 2320/043* (2013.01)

(56) References Cited

U.S. PATENT DOCUMENTS

| | | | | |
|---|---|---|---|---|
| 7,876,390 | B2 | 1/2011 | Yang | |
| 8,018,404 | B2 | 9/2011 | Ono | |
| 8,111,221 | B2 | 2/2012 | Ono | |
| 8,248,331 | B2 | 8/2012 | Ono | |
| 8,325,317 | B2 | 12/2012 | Yang | |
| 8,432,338 | B2 | 4/2013 | Ono | |
| 8,497,826 | B2 | 7/2013 | Ono | |
| 8,599,222 | B2 | 12/2013 | Ishiguro et al. | |
| 8,970,574 | B2 | 3/2015 | Kim et al. | |
| 2004/0233141 | A1 | 11/2004 | Matsumoto | |
| 2006/0231740 | A1 | 10/2006 | Kasai | |
| 2006/0238461 | A1* | 10/2006 | Goh et al. | 345/76 |
| 2007/0263132 | A1 | 11/2007 | Yang | |
| 2008/0074357 | A1* | 3/2008 | Kanda | 345/76 |
| 2009/0109149 | A1* | 4/2009 | Akimoto et al. | 345/76 |
| 2009/0179838 | A1* | 7/2009 | Yamashita | G09G 3/3233 345/84 |
| 2009/0219231 | A1* | 9/2009 | Yamamoto | G09G 3/3233 345/76 |
| 2009/0284515 | A1* | 11/2009 | Tsuge | 345/211 |
| 2010/0007645 | A1 | 1/2010 | Ono | |
| 2010/0053233 | A1 | 3/2010 | Ishiguro et al. | |
| 2010/0201674 | A1 | 8/2010 | Kim et al. | |
| 2010/0259531 | A1 | 10/2010 | Ono | |
| 2011/0057966 | A1 | 3/2011 | Ono | |
| 2011/0092008 | A1 | 4/2011 | Yang | |
| 2011/0109664 | A1* | 5/2011 | Toyomura et al. | 345/690 |
| 2011/0164024 | A1 | 7/2011 | Ono | |
| 2011/0285760 | A1 | 11/2011 | Ono | |
| 2012/0086699 | A1 | 4/2012 | Ono | |
| 2012/0242643 | A1 | 9/2012 | Ono | |
| 2014/0055508 | A1 | 2/2014 | Ishiguro et al. | |

FOREIGN PATENT DOCUMENTS

| | | |
|---|---|---|
| CN | 101800026 | 8/2010 |
| JP | 2001-083924 | 3/2001 |
| JP | 2003-186439 | 7/2003 |
| JP | 2006-301159 | 11/2006 |
| JP | 2006-301647 | 11/2006 |
| JP | 2009-134110 | 6/2009 |
| JP | 2010-078947 | 4/2010 |
| WO | 2008/152817 | 12/2008 |
| WO | 2010/041426 | 4/2010 |
| WO | 2011/030370 | 3/2011 |
| WO | 2011/070615 | 6/2011 |

OTHER PUBLICATIONS

Office Action from State Intellectual Property Office (SIPO) of the People's Republic of China in Chinese Patent Application No. 201180075029.0, dated Feb. 29, 2016, together with a partial English language translation.

* cited by examiner

DISPLAY DEVICE AND METHOD OF CONTROLLING THE SAME

TECHNICAL FIELD

The present invention relates to display devices and methods of controlling the same, and particularly to a display device that uses organic electroluminescence (EL) elements and to a method of controlling the same.

BACKGROUND ART

Recent years have seen progress in the development and practical implementation of display devices (hereafter referred to as organic EL display devices) using organic EL elements. Generally, an organic EL display device includes (i) a display unit having, arranged in a matrix, pixel circuits each having an organic EL element, and (ii) a drive circuit for driving the display unit.

A fundamental pixel circuit used in an active-matrix organic EL display device is configured to include an organic EL element, a selection switching transistor, a capacitor, and a drive transistor. In such a pixel circuit, data voltage is held in the capacitor by, first, placing the selection switching transistor connected to the signal line in a conducting state, storing the data voltage corresponding to the luminance of the pixel into the capacitor from the signal line, and subsequently placing the selection switching transistor in a non-conducting state. Next, a current commensurate in size to the voltage held in the capacitor is supplied from the drive transistor to the organic EL element, and the organic EL element emits light at a luminance corresponding to the data voltage, according to the current supplied from the drive transistor.

With respect to such fundamental pixel circuits, there have been various proposals for pixel circuits provided with a configuration for causing an organic EL element to emit light at a luminance that more precisely corresponds to the data voltage, and for methods of controlling the same (for example, Patent Literature (PTL) 1).

FIG. 20 is a circuit diagram illustrating a conventional pixel circuit 90 disclosed in PTL 1.

The pixel circuit 90 includes a drive transistor TD, switching transistors T1 to T3, a capacitor Cs, and an organic EL element EL.

The pixel circuit 90 is supplied with control signals from the scanning line drive circuit 4 via signal lines SCAN and MERGE, and is supplied a with data voltage corresponding to luminance, from the signal line drive circuit 5 via a data line DATA. Furthermore, the pixel circuit 90 is supplied with positive and negative power source voltage used in the light-emission of the organic EL element EL, from a power source circuit not shown in the figure via power source lines VDD and VSS, and supplied with a reference voltage via a reference voltage line Vref.

Although complex voltage change caused by voltage drops occur at the points where the power source lines VDD and VSS, which supply current to the organic EL element EL, are connected to the pixel circuit 90, a steady voltage drop rarely occurs at the reference voltage line Vref which does not supply direct current.

The pixel circuit 90 having the above configuration operates in the subsequent manner according to the control signal supplied. It should be noted that, in the subsequent description, the operation of applying a voltage A to one end of the capacitor and a voltage B to the other end of the capacitor, and holding in the capacitor a voltage (A-B) which is the difference between voltage A and voltage B is expressed as holding voltage A in the capacitor with reference to voltage B. This expression shall be used throughout the Specification.

First, the switching transistor T2 is placed in the non-conducting state, and, with the capacitor Cs being electrically separated from the current path within the pixel, the switching transistors T1 and T3 are placed in the conducting state. The capacitor Cs holds the data voltage with reference to the reference voltage.

At this time, the voltage held in the capacitor Cs is completely unaffected by the change in power source voltage. Next, the switching transistors T1 and T3 are placed in the non-conducting state, the switching transistors T2 is placed in the conducting state, and the voltage held in the capacitor Cs is applied across the gate terminal and the source terminal of the drive transistor TD.

As a result, since the drive transistor TD supplies the organic EL element EL with a current that is in accordance with only the data voltage, the organic EL element EL emits light at a precise luminance corresponding to the data voltage.

CITATION LIST

Patent Literature

[PTL 1] International Publication No. WO2010-041426

SUMMARY OF INVENTION

Technical Problem

Aside from the change in power source voltage which is solved by the above-described conventional technique, the causes of loss of light emission precision in organic EL elements includes, for example, change in the threshold voltage of the drive transistor. Threshold voltage change refers to the phenomenon in which the subsequent threshold voltage changes depending on the size of the bias voltage that is applied across the gate terminal and the source terminal of the drive transistor.

Because the drive transistor supplies current of a desired size to the organic EL element when a bias voltage of a size corresponding to luminance is applied across the gate terminal and the source terminal, the threshold voltage of the drive transistor changes according to the voltage across the gate terminal and source terminal which corresponds to the luminance in the preceding frame, and thus affects the subsequent frame. In other words, when the threshold voltage changes, an error occurs in the amount of current supplied by the drive transistor to the organic EL element with respect to the data voltage, and this error is reflected in the error in the light-emitting luminance of the organic EL element.

The above situation is illustrated in FIG. 6A. FIG. 6A is a graph illustrating the time variation of luminance when an intermediate gray scale (gray) is displayed after black or white is displayed in the preceding frames. For the 10 or more frames following the changing of the display, non-uniformity of light-emitting luminance depending on whether the display in the preceding frame is white or black was observed. In particular, a big difference was observed in the light-emitting luminance in the first 1 to 2 frames. As a result of this phenomenon, as illustrated in FIG. 6B for example, when a black or white window is scrolled in an intermediate gray scale background color, it takes a long time for a region that the window passes which once again turns to the background color to settle down to the correct intermediate gray scale luminance, and thus display deterioration referred to as residual image is visible.

However, display deterioration caused by drive transistor threshold voltage change following an abrupt gray scale change and a countermeasure thereof are not taken into consideration in the above-described conventional technique.

The present invention was conceived in view of the aforementioned problem and has as an object to provide (i) a display device capable of causing an organic EL element to emit light at a more precise luminance that corresponds to data voltage and (ii) a method of controlling the same.

Solution to Problem

In order to achieve the aforementioned object, a display device according to an aspect of the present invention is a display device including a display unit including pixel circuits, wherein each of the pixel circuits includes: a drive transistor including a source terminal and a drain terminal, one of the source terminal and the drain terminal being connected to a first power source line transmitting a first power source voltage; a first capacitive element including a first terminal connected to a gate terminal of the drive transistor; a first switching element which switches between conduction and non-conduction between a second terminal of the first capacitive element and a data line transmitting a data voltage corresponding to luminance; a second switching element which switches between conduction and non-conduction between the second terminal of the first capacitive element and the source terminal of the drive transistor; a third switching element which switches between conduction and non-conduction between the first terminal of the first capacitive element and a reference voltage line transmitting a fixed reference voltage; a light-emitting element including: a first terminal connected to an other of the source terminal and the drain terminal of the drive transistor; and a second terminal connected to a second power source line transmitting a second power source voltage; and a second capacitive element including: a first terminal connected to the second terminal of the first capacitive element; and a second terminal connected to one of the first power source line and the reference voltage line, wherein, when the third switching element is in a conducting state, the fixed reference voltage is set so that a forward bias voltage larger than a threshold voltage of the drive transistor is applied across the gate terminal and the source terminal and across the gate terminal and the drain terminal of the drive transistor.

Advantageous Effects of Invention

A display device according to the present invention is capable of suppressing change in the threshold voltage of the drive transistor and causing a light-emitting element to emit light at a more precise luminance, by applying a fixed forward bias voltage which is larger than the threshold voltage to turn ON the drive transistor.

DESCRIPTION OF EMBODIMENTS

Figure 1:
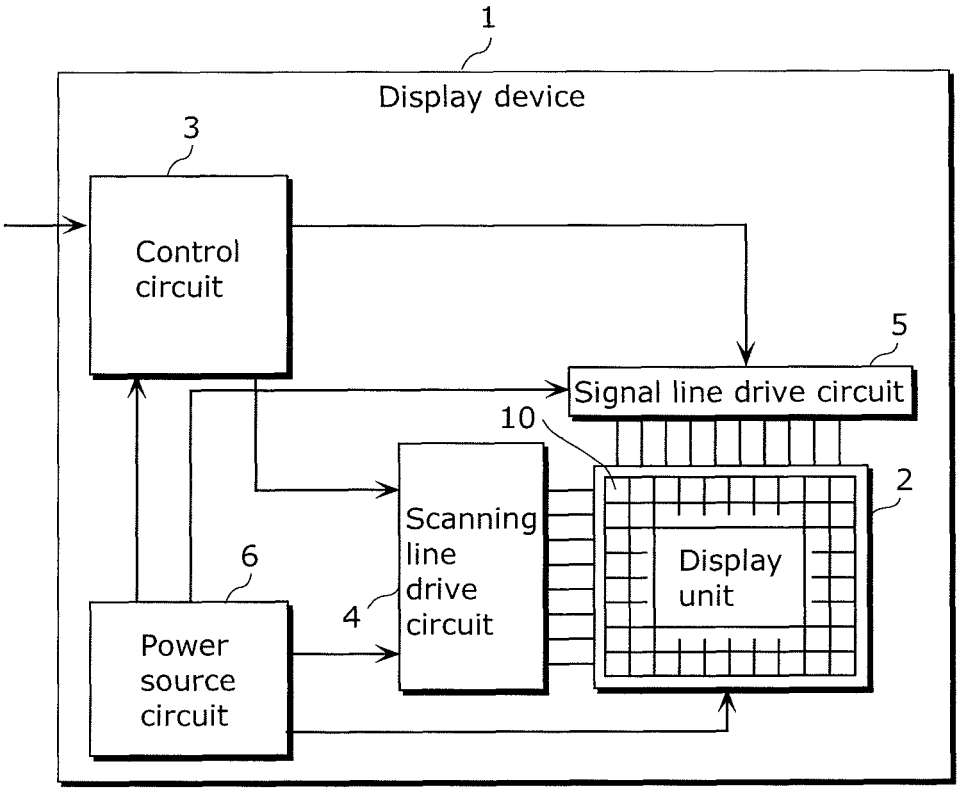
FIG. 1 is a function block diagram illustrating an example of a configuration of a display device in Embodiment 1.

A control method according to an aspect of the present invention is a method of controlling a display device including a light-emitting element and a drive transistor which supplies current to the light-emitting element, the method including suppressing change in a threshold voltage of the drive transistor by applying a predetermined reference voltage to a gate terminal of the drive transistor via a reference voltage line connected to the gate terminal and applying a fixed voltage from a power source line connected to one of a source terminal and a drain terminal of the drive transistor to an other of the source terminal and the drain terminal of the drive transistor, wherein in the suppressing, the predetermined reference voltage is set so that a voltage across the gate terminal and the source terminal of the drive transistor is a voltage larger than the threshold voltage of the drive transistor.

According to such a control method, a fixed forward bias voltage which is larger than the threshold voltage is applied to turn ON the drive transistor and suppress change in the threshold voltage of the drive transistor in the suppressing, and thus it is possible to cause a light-emitting element to emit light at a more precise luminance.

Furthermore, in each of the power source line and a power source line for an EL common terminal, a voltage set in a light emission period and the voltage set in the suppressing may be equal.

Such a control method is useful in simplifying the circuit configuration of the display device since there is no need to change the voltage of the power source lines between the light emission period and the suppressing.

The control method may further include holding a data voltage corresponding to light-emission luminance, in a capacitive element including one terminal connected to the gate terminal of the drive transistor, wherein at least part of the suppressing and part of the holding may be performed in parallel in a same period.

According to such a control method, by taking sufficient time to execute the suppressing in parallel with the holding, it is possible to further suppress change in the threshold voltage of the drive transistor.

A display device according to an aspect of the present invention is a display device comprising a display unit including pixel circuits, wherein each of the pixel circuits includes: a drive transistor including a source terminal and a drain terminal, one of the source terminal and the drain terminal being connected to a first power source line transmitting a first power source voltage; a first capacitive element including a first terminal connected to a gate terminal of the drive transistor; a first switching element which switches between conduction and non-conduction between a second terminal of the first capacitive element and a data line transmitting a data voltage corresponding to luminance; a second switching element which switches between conduction and non-conduction between the second terminal of the first capacitive element and the source terminal of the drive transistor; a third switching element which switches between conduction and non-conduction between the first terminal of the first capacitive element and a reference voltage line transmitting a fixed reference voltage; a light-emitting element including: a first terminal connected to an other of the source terminal and the drain terminal of the drive transistor; and a second terminal connected to a second power source line transmitting a second power source voltage; and a second capacitive element including: a first terminal connected to the second terminal of the first capacitive element; and a second terminal connected to one of the first power source line and the reference voltage line, wherein, when the third switching element is in a conducting state, the fixed reference voltage is set so that a forward bias voltage larger than a threshold voltage of the drive transistor is applied across the gate terminal and the source terminal of the drive transistor.

According to such a configuration, it is possible to suppress change in the threshold voltage of the drive transistor and cause the light-emitting element to emit light at a more precise luminance, by applying a fixed forward bias voltage which is larger than the threshold voltage to turn ON the drive transistor.

Furthermore, each of the pixel circuits may include a fourth switching element inserted in a path of current supplied from the drive transistor to the light-emitting element, the fourth switching element switching between conduction and non-conduction in the path of the current.

Furthermore, a control line for controlling the first switching element and a control line for controlling the third switching element may use a shared line, and a control line for controlling the second switching element and a control line for controlling the fourth switching element may use a shared line.

Furthermore, the display device may further include a power source voltage control circuit which controls, on a pixel row basis, power source voltage transmitted by the first power source line.

Such a configuration is useful in improving display contrast and reducing power consumption because the light emission of the light-emitting element can be inhibited while a fixed forward bias voltage is being applied to the drive transistor in order to suppress change in threshold voltage.

Hereinafter, an embodiment of the present invention shall be described. It is to be noted that, in all the figures, the same reference signs are given to components that fulfill the same functions and redundant description thereof shall be omitted.

Embodiment 1

A display device according to Embodiment 1 is a display device including a display unit having, arranged in a matrix, pixel circuits each being configured to suppress drive transistor threshold change.

Hereinafter, Embodiment 1 of the present invention shall be described with reference to the Drawings.

FIG. 1 is a function block diagram illustrating an example of a configuration of a display device 1 in Embodiment 1.

The display device 1 includes a display unit 2, a control circuit 3, a scanning line drive circuit 4, a signal line drive circuit 5, and a power source circuit 6.

The display unit 2 includes plural pixel circuits 10 which are arranged in a matrix. Each row in the matrix is provided with a scanning signal line, and each column in the matrix is provided with a data signal line.

The control circuit 3 is a circuit that controls the operation of the display device 1, receives a video signal from an external source, and controls the scanning line drive circuit 4 and the signal line drive circuit 5 so that the image represented by the video signal is displayed by the display unit 2.

The scanning line drive circuit 4 supplies a control signal for controlling the operation of the pixel circuit 10, to the pixel circuit 10 via the scanning signal line provided in each row of the display unit 2.

The signal line drive circuit 5 supplies a data signal corresponding to the luminance, to the pixel circuit 10 via the data signal line provided in each column of the display unit 2.

The power source circuit 6 supplies power for the operation of the display device 1, to the respective parts of the display device 1.

Figure 2:
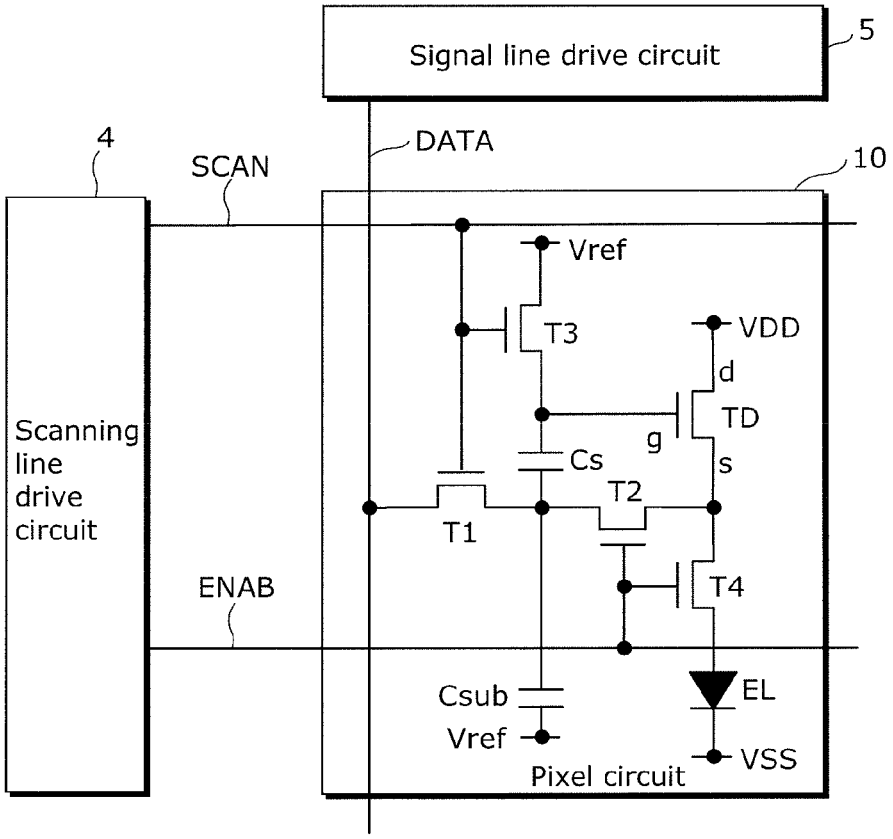
FIG. 2 is a circuit diagram illustrating an example of a configuration of a pixel circuit in Embodiment 1.

FIG. 2 is a circuit diagram illustrating an example of a configuration of a pixel circuit 10, and the connection between the pixel circuit 10 and the scanning line drive circuit 4 and signal line drive circuit 5.

Each of the rows of the display unit 2 is provided with signal lines SCAN and ENAB as scanning signal lines connected in common to the pixel circuits 10 provided in the same row, and each of the columns of the display unit 2 is provided with a data line DATA as a data signal line connected in common to the pixel circuits 10 provided in the same column.

Furthermore, the display unit 2 is provided with a power source line VDD for transmitting and distributing to the pixel circuit 10 the positive power source voltage supplied from the power source circuit 6, a power source line VSS for transmitting and distributing to the pixel circuit 10 the negative power source voltage supplied from the power source circuit 6, and a reference voltage line Vref for transmitting and distributing to the pixel circuit 10 a fixed reference voltage supplied from the power source circuit 6. The power source lines VDD and VSS and the reference voltage line Vref are connected in common to all of the pixel circuits 10.

Although complex voltage change caused by voltage drops occur at the points where the respective power source lines VDD and VSS, which supply current to the organic EL element EL, are connected to the pixel circuit 10, a steady voltage drop does not occur at the reference voltage line Vref which does not supply direct current.

Each of the pixel circuits 10 arranged in the display unit 2 is connected to the scanning line drive circuit 4 by the signal lines SCAN and ENAB of the row in which the pixel 10 is located, and connected to the signal line drive circuit 5 by the data line DATA of the column in which the pixel 10 is located.

The signal lines SCAN and ENAB transmit, from the scanning line drive circuit 4 to the pixel circuit 10, a control signal for controlling the operation of the pixel circuit 10. The data line DATA transmits a data signal corresponding to luminance, from the signal line drive circuit 5 to the pixel circuit 10.

The pixel circuit 10 is a circuit that causes the organic EL element to emit light at a luminance corresponding to the data signal, and includes a drive transistor TD, switching transistors T1 to T4, capacitors Cs and Csub, and an organic light-emitting element EL. Each of the drive transistor TD and the switching transistors T1 to T4 is configured of an N-type thin film transistor (TFT).

The drive transistor TD includes a drain terminal d connected to the power source line VDD, and a source terminal S connected to a first terminal (at the upper side in the figure) of the organic EL element 1 via the switching transistor T4.

The capacitor Cs includes a first terminal (at the upper side in the figure) connected to a gate terminal g of the drive transistor TD.

The capacitor Csub includes a first terminal (at the upper side in the figure) connected to a second terminal (at the lower side in the figure) of the capacitor Cs, and a second terminal (at the lower side in the figure) connected to a fixed voltage (for example, the power source line VDD or the reference voltage line Vref). It should be noted that the capacitor Csub need not be a capacitor formed in a dedicated region, and may be a parasitic capacitance located between a conductor included in the second terminal of the Capacitor Cs and a conductor included in the power source line VDD or the reference voltage line Vref or the signal lines SCAN and ENAB. Furthermore, the capacitor Csub may be the parasitic capacitance of the switching transistors T1 and T2. Therefore, a pixel circuit in which the capacitor Csub is not clearly indicated is also included in the present invention.

The organic EL element EL includes a second terminal (at the lower side of the figure) connected to the power source line VSS.

The switching transistor T1 switches between conduction and non-conduction between the second terminal (at the lower side in the figure) of the capacitor Cs and the data line DATA, according to a control signal transmitted by the signal line SCAN.

The switching transistor T2 switches between conduction and non-conduction between the source terminal s of the drive transistor TD and the second terminal of the capacitor Cs, according to a control signal transmitted by the signal line ENAB.

The switching transistor T3 switches between conduction and non-conduction between the first terminal of the capacitor Cs and the reference voltage line Vref, according to a control signal transmitted by the signal line SCAN.

The switching transistor T4 switches between conduction and non-conduction between the source terminal s of the drive transistor TD and the second terminal (at the upper side in the figure) of the organic EL element EL, according to a control signal transmitted by the signal line ENAB.

Here, the switching transistors T1 to T4 are examples of first to fourth switching elements, respectively; the capacitor Cs is an example of a capacitive element; and the organic EL element EL is an example of a light-emitting element. Furthermore, the power source line VDD is an example of a first power source line, and the power source line VSS is an example of a second power source line. Furthermore, the data signal is an example of a data voltage.

Figure 3:
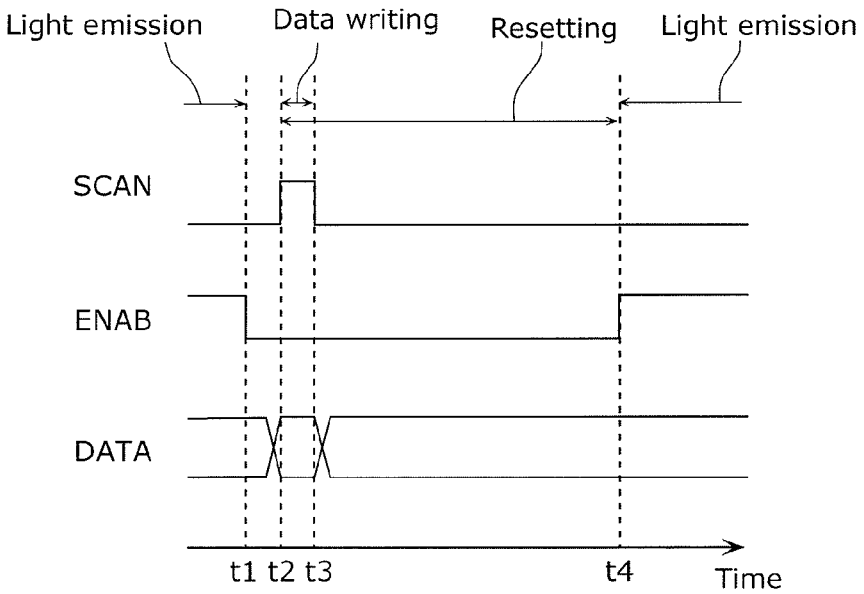
FIG. 3 is a timing chart illustrating an example of control signals and data signals in Embodiment 1.

FIG. 3 is a timing chart illustrating, over a 1-frame period, an example of the control signals and data signals for operating the pixel circuit 10. In FIG. 3, the vertical axis denotes the level of each signal, and the horizontal axis represents the passing of time. Since the switching transistors T1 to T4 of the pixel circuit 10 are configured of N-type TFTs, each of the switching transistors T1 to T4 is in the conducting state in a period in which the corresponding control signal is at the HIGH level, and is in the non-conducting state in a period in which the corresponding control signal is at the LOW level.

The operations of the pixel circuit 10 performed according to the control signals and data signals illustrated in FIG. 3 shall be described with reference to (a) to (c) in FIG. 4. It should be noted that, for convenience of description, the voltage at the connection points between each of the power source lines VDD and VSS and the pixel circuit 10 shall be denoted as positive power source voltage VDD and negative power source voltage VSS, respectively, and the voltage of the reference voltage line Vref shall be denoted as reference voltage Vref.

At a time t1, light emission in the preceding frame ends.

In a data writing period from time t2 to t3, a data writing operation is performed. The data writing operation is an operation of obtaining the data voltage Vdata from the data line DATA via the switching transistor T1 (that is, writing the data voltage Vdata into the pixel circuit 10).

Figure 4:
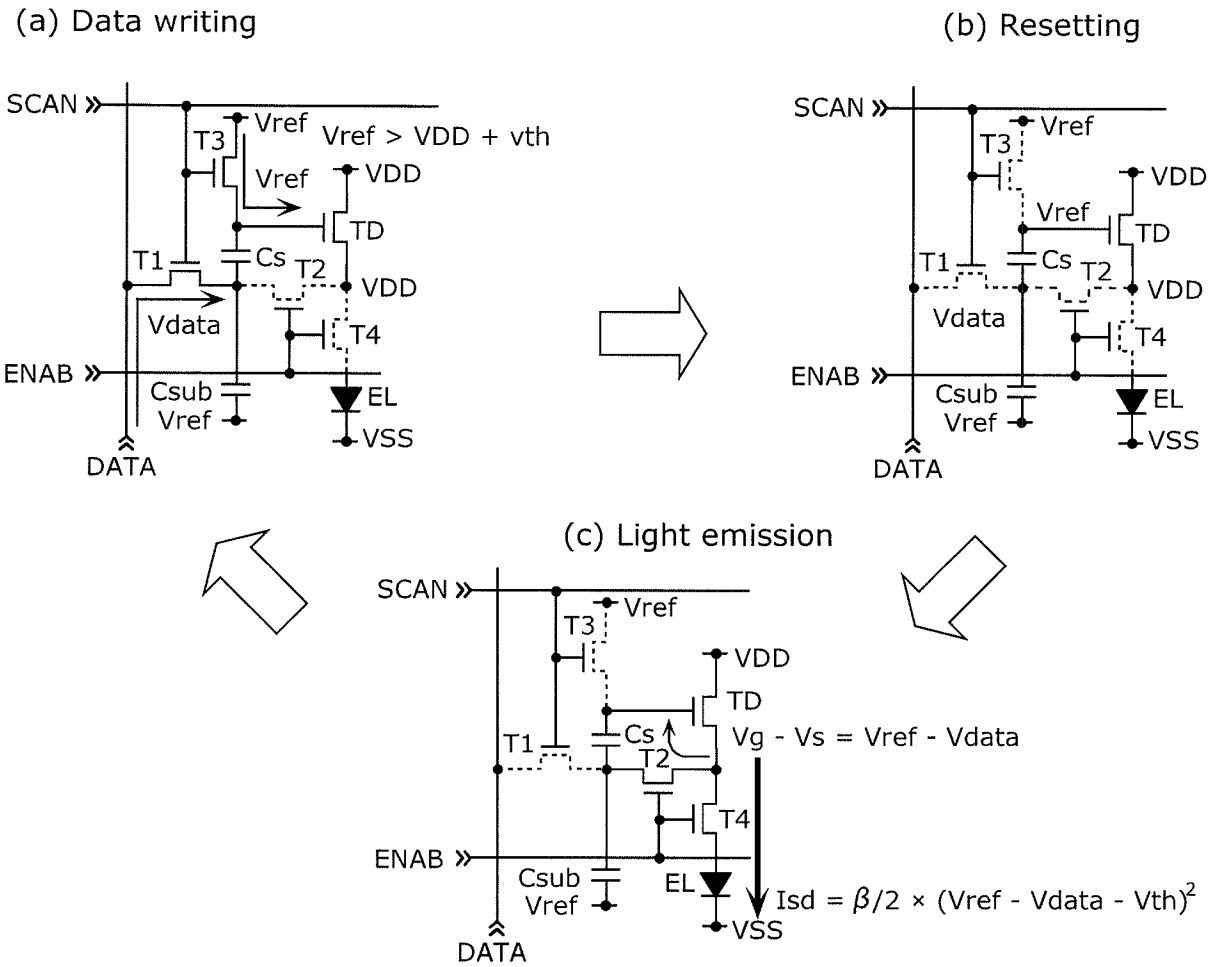
FIGS. 4 (*a*)-(*c*) are circuit diagram diagrams illustrating an example of an operation of a pixel circuit in Embodiment 1.

In FIG. 4, (a) is a circuit diagram for describing the data writing operation. The switching transistors T2 and T4 which become non-conducting in the data writing period are shown using dotted lines.

In the data writing period, the switching transistors T1 and T3 are in the conducting state, the data voltage Vdata is obtained from the data line DATA and held in the capacitor Cs with reference to the reference voltage Vref. In order to perform a reset operation to be described later, a voltage that is higher than a voltage obtained by adding a threshold voltage Vth to the positive power source voltage VDD is used for the reference voltage Vref.

In a reset period from time t2 to t4, a reset operation is performed. Part of the reset period overlaps with the data writing period, and the reset operation is performed in parallel with the aforementioned data writing operation, from the time t2 to t3. The reset operation is an operation of applying a forward bias voltage that is higher than the threshold voltage Vth of the drive transistor TD to turn ON the drive transistor TD, in order to suppress change in the threshold voltage of the drive transistor.

In FIG. 4, (b) is a circuit diagram for describing the reset operation. The switching transistors T1, T2, T3, and T4 which become non-conducting from the time t3 onward in the reset period are shown using dotted lines.

In the reset period, the reference voltage Vref is applied to the gate terminal g of the driver transistor TD from the reference voltage line Vref from the time t2 to t3, and the reference voltage Vref is applied to the gate terminal g of the drive transistor TD from a first terminal (at the upper side in the figure) of the capacitor Cs from the time t3 to t4.

As described earlier, the reference voltage Vref is higher than a voltage obtained by adding a threshold voltage Vth to the positive power source voltage VDD, and thus the drive transistor TD is turned ON, and the reset operation is performed. At this time, since the switching transistor T4 is in the non-conducting state, the light emission of the organic EL element EL is inhibited, and the potentials of the drain terminal and the source terminal of the drive transistor TD are both equal to the positive power source voltage VDD. This suppresses the deterioration of display contrast and increased power consumption caused by unnecessary light emission by the organic EL element EL.

It should be noted that inhibiting the light emission of the organic EL element EL in the reset period is not essential to the suppression of the change in the threshold voltage Vth of the drive transistor TD. The effect of suppressing the change in the threshold voltage Vth of the drive transistor TD can be confirmed even when the reset operation is performed without inhibiting the light emission of the organic EL element EL.

In the light emission period from the time t4 onward, a light-emitting operation is performed. The light-emitting operation is an operation of applying a bias voltage reflecting the data voltage Vdata across the gate terminal and source terminal of the drive transistor TD to supply current from the drive transistor TD to the organic EL element EL.

In FIG. 4, (c) is a circuit diagram for describing the light-emitting operation. The switching transistors T1 and T3 which become non-conducting in the light emission period are shown using dotted lines.

In the light emission period, the switching transistors T1 and T3 are placed in the non-conducting state and the switching transistors T2 is placed in the conducting state, and a voltage Vref−Vdata held in the capacitor Cs is applied across the gate terminal and the source terminal of the drive transistor TD.

As a result, a current $Isd=\beta/2\times(Vref-Vdata-Vth)^2$ of a size corresponding to the data voltage Vdata is supplied from the drive transistor TD to the organic EL element EL.

Due to the reset operation preceding the light-emitting operation, in any frame, the threshold voltage Vth of the drive transistor TD is set to an approximately constant value in that frame period, regardless of the display state in the preceding frame, and thus the effect of threshold voltage change for one frame is eliminated, and it is possible to cause the organic EL element EL to emit light at a precise luminance corresponding to the data voltage Vdata.

Results of an experiment performed to confirm the light-emitting characteristics of the pixel circuit 10 configured in the manner described above shall be described. In the experiment, the time variation of light-emitting luminance of the pixel circuit is measured for a working example using the pixel circuit 10 and a comparative example using the pixel circuit 90 of the conventional technique.

Figure 5A:
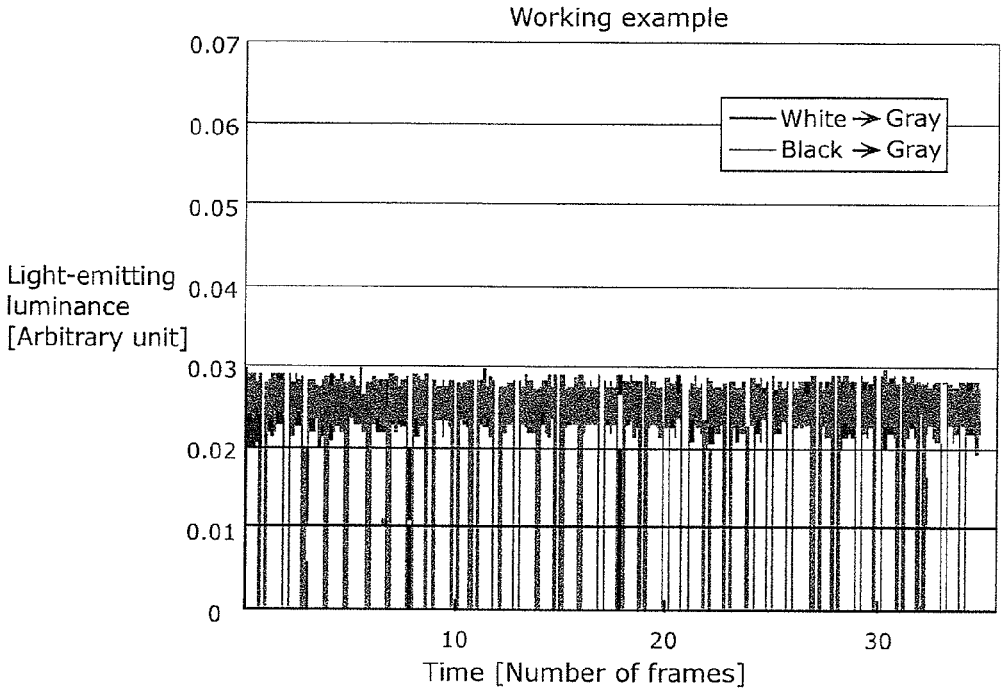
FIG. 5A is a graph illustrating time variation of light-emitting luminance of a pixel circuit in a working example.

FIG. 5A is a graph illustrating the time variation of the light-emitting luminance of the pixel circuit 10 of the working example, and illustrates the measurement results for light-emitting luminance for 35 frames immediately after switching from a white or black display to a gray display.

In the working example, although a slight difference in light-emitting luminance can be observed in the first frame following the switching to a gray display depending on whether the display in the preceding frame is white or black, approximately the same light-emitting luminance can be obtained from the second frame onward, and there is rapid convergence to the correct gray display. Furthermore, there is also almost no change in the light-emitting luminance within the respective frames.

Figure 5B:
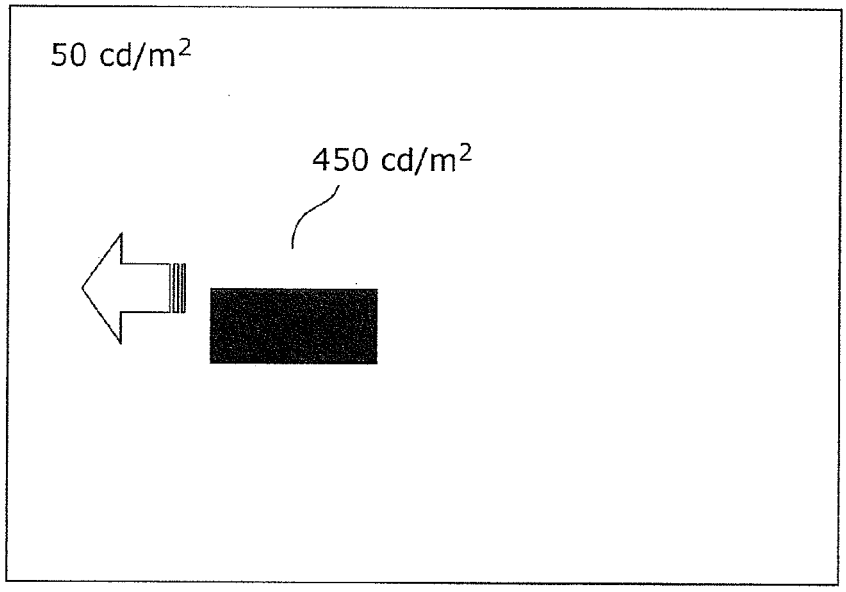
FIG. 5B illustrates an example of scrolling display by a display unit using the pixel circuit in the working example.

As a result, as illustrated in FIG. 5B for example, even when a black or white window is scrolled in an intermediate gray scale background color, a region that the window passes which once again turns to the background color settles down rapidly to the correct intermediate gray scale luminance, and thus a residual image is not visible.

Figure 6A:
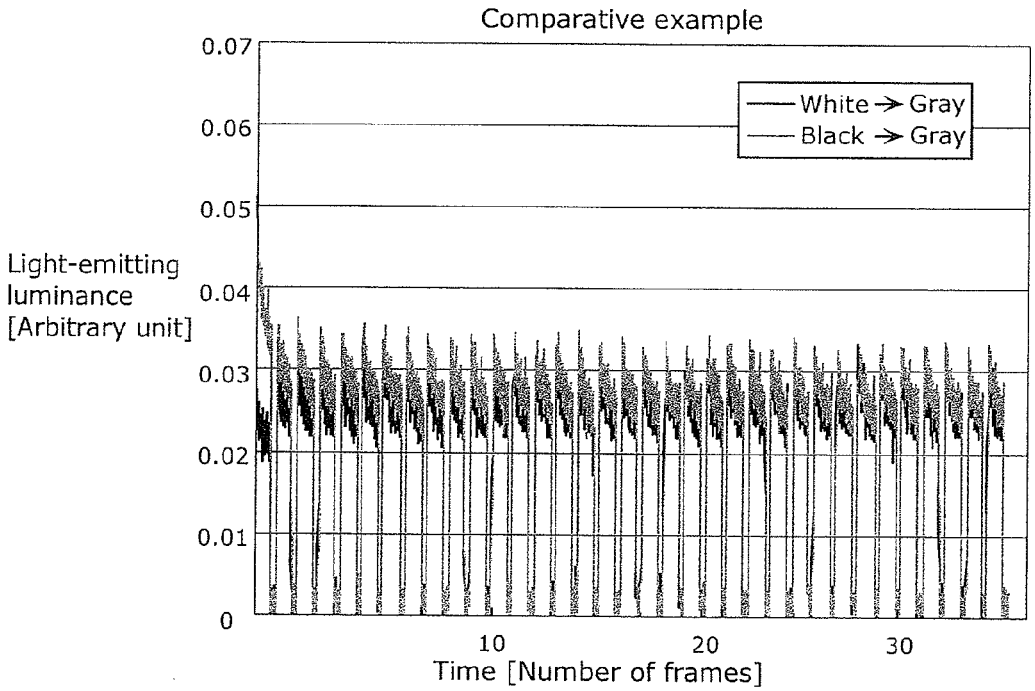
FIG. 6A is a graph illustrating time variation of light-emitting luminance of a pixel circuit in a comparative example.

In contrast, FIG. 6A is a graph illustrating the time variation of the light-emitting luminance of the pixel circuit 90 of the comparative example, and illustrates the measurement results for light-emitting luminance for 35 frames immediately after switching from a white or black display to a gray display.

Figure 6B:
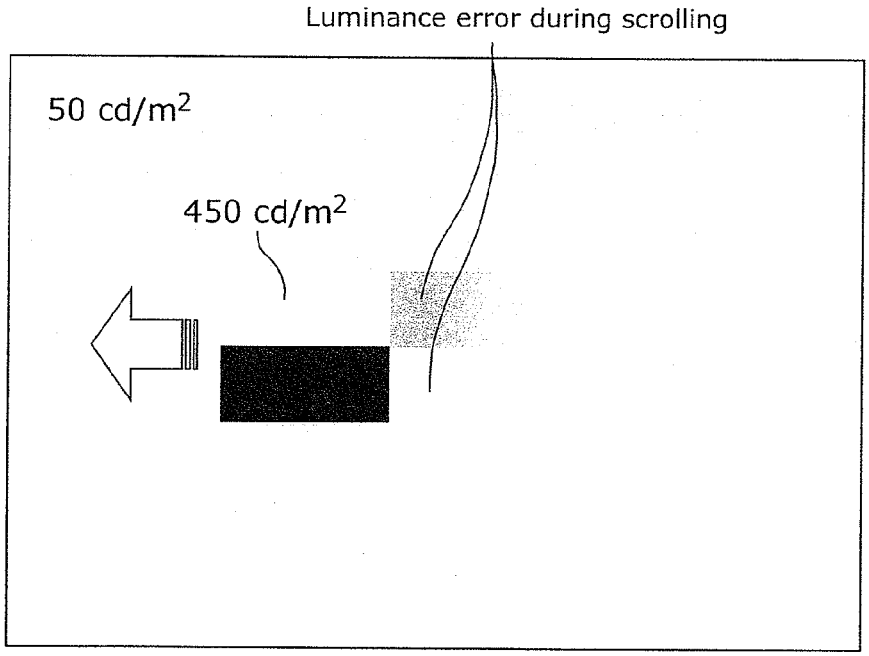
FIG. 6B illustrates an example of scrolling display by a display unit using the pixel circuit in the comparative example.

In the comparative example, non-uniformity of light-emitting luminance was observed for 10 or more frames following the switching to a gray display, depending on whether the display in the preceding frame is white or black. In particular, a big difference was observed in the light-emitting luminance in the first 1 to 2 frames. As pointed out in the Problem section, as a result of this phenomenon, as illustrated in FIG. 6B, the residual image when a white or black window is scrolled in an intermediate gray scale background color is visible.

Figure 7:
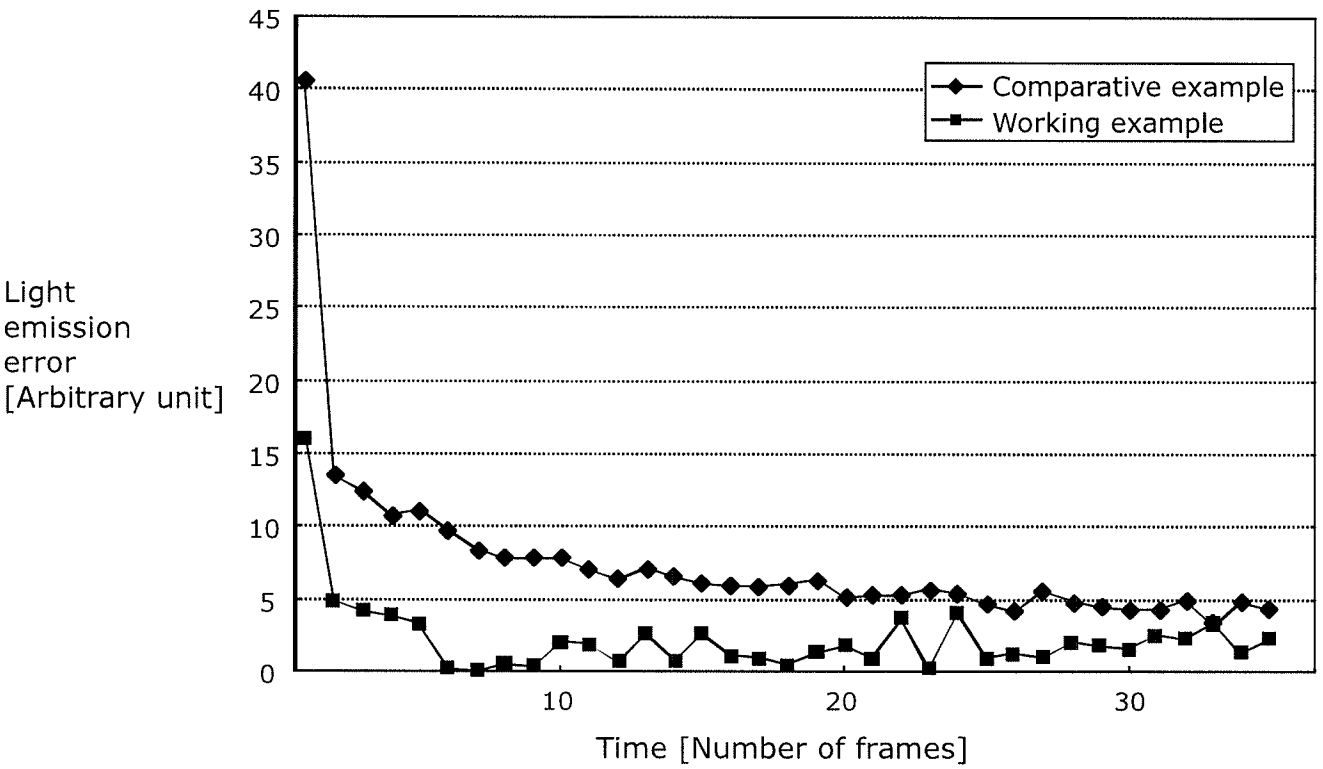
FIG. 7 is a graph illustrating the per frame light-emitting luminance error for the working example and the comparative example.

FIG. 7 is a graph illustrating inter-frame transition of the luminance error in each frame. Here, the deviation of the actual luminance from the correct gray luminance is shown as the luminance error. Compared to the comparative example, in the working example, there is less deviation of luminance and there is rapid convergence to the correct gray display.

These results confirm the advantageous effect of applying a fixed forward bias voltage that is larger than the threshold voltage Vth to reset the drive transistor TD to the ON state, and thereby suppressing change in the threshold voltage Vth of the drive transistor TD and causing the organic EL element EL to emit light at a precise luminance corresponding to the data voltage Vdata.

In addition, by inhibiting the light emission of the organic EL element EL in the reset period, the advantageous effect of improving display contrast and reducing power consumption can be obtained.

It should be noted that the above-described pixel circuit 10 may be modified in the manner described below.

Figure 8:
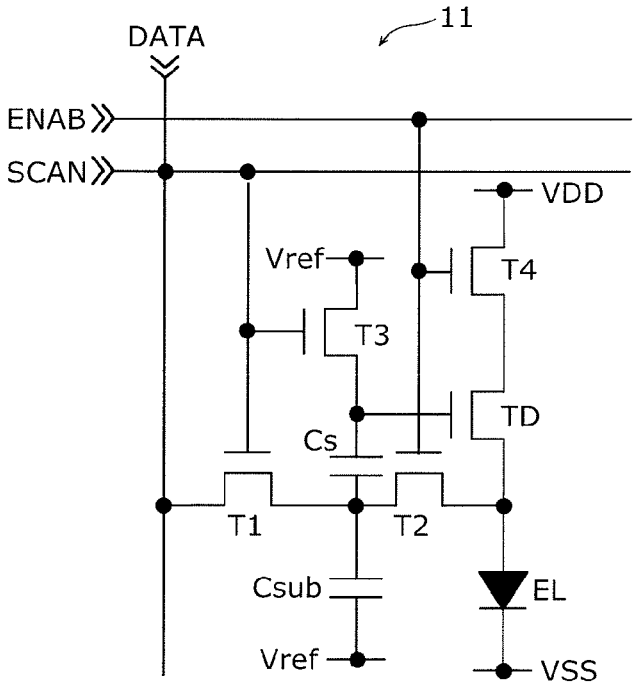
FIG. 8 is a circuit diagram illustrating an example of a configuration of a pixel circuit in Embodiment 1.

For example, as in a pixel circuit 11 illustrated in FIG. 8, the switching transistor T4 may be inserted between the drive transistor TD and the power source line VDD. In order to inhibit the light emission of the organic EL element EL, the switching transistor T4 may be inserted anywhere along the path of the current supplied from the drive transistor TD to the organic EL element EL. The pixel circuit 11 performs the same operation as the pixel circuit 10, according to the control signals illustrated in FIG. 3.

Figure 9:
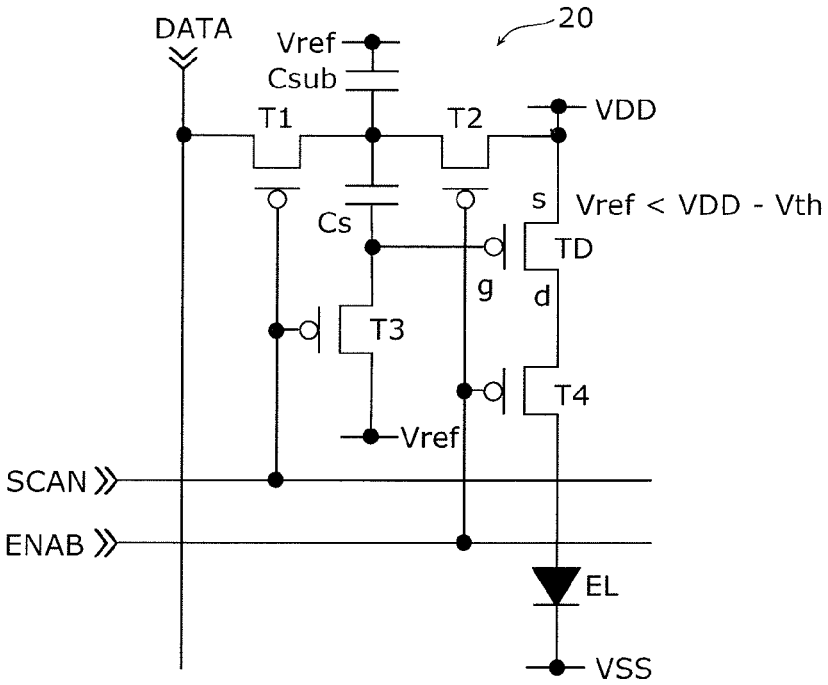
FIG. 9 is a circuit diagram illustrating an example of a configuration of a pixel circuit in Embodiment 1.

For example, as in a pixel circuit 20 illustrated in FIG. 9, the drive transistor TD and the switching transistors T1 to T4 may each be configured of a P-type transistor. The pixel circuit 20 performs the same operation as the pixel circuit 10 illustrated in FIG. 3 when provided with control signals and data signals having respective levels obtained by simply reversing the levels of the control signals and data signals used in the pixel circuit 10. Therefore, the same advantageous effect as with the circuit pixel 10 can be obtained with the pixel circuit 20.

Modification of Embodiment 1

A modification of Embodiment 1 of the present invention shall be described with reference to the drawings. This modification shows an example of a configuration and operations for controlling each of the switching transistors T1 and T3 of the pixel circuit 10 illustrated in FIG. 2 with an independent timing.

Figure 10:
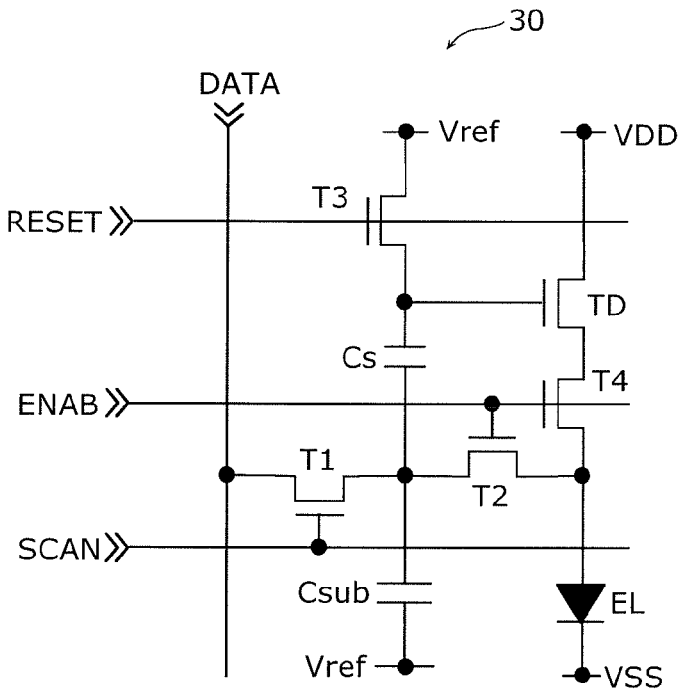
FIG. 10 is a circuit diagram illustrating an example of a configuration of a pixel circuit in a modification of Embodiment 1.

FIG. 10 is a circuit diagram illustrating an example of a configuration of a pixel circuit 30 in this modification of Embodiment 1. The basic configuration of the pixel circuit 30 is the same as that of the pixel circuit 10 but is different in that the gate terminal of each of the switching transistors T1 and T3 is connected to an independent control line. To adapt to the pixel circuit 30, a signal line RESET is provided to each of the rows of the display unit 2.

In the pixel circuit 30, the switching transistor T3 switches between conduction and non-conduction between the first terminal (at the upper side in the figure) of the capacitor Cs and a reference voltage line Vref, according to a control signal transmitted by the signal line RESET.

Figure 11:
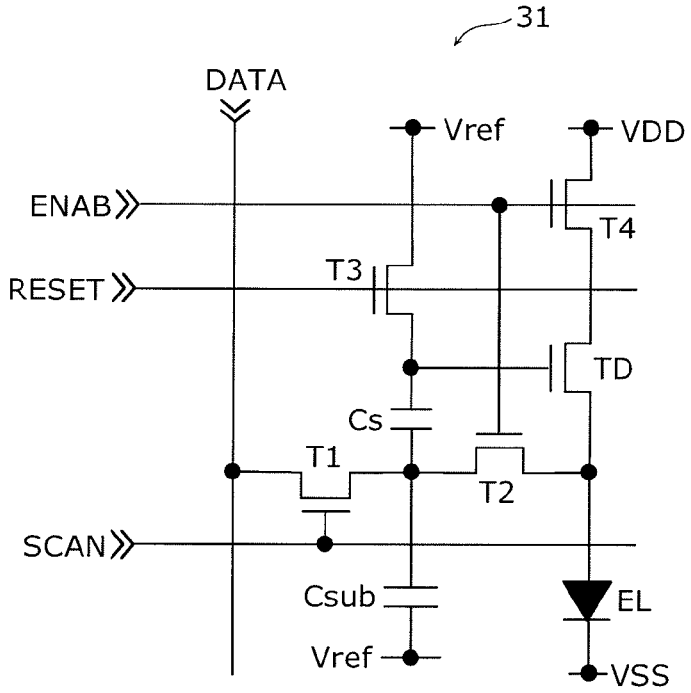
FIG. 11 is a circuit diagram illustrating an example of a configuration of a pixel circuit in a modification of Embodiment 1.

It should be noted that, as in a pixel circuit 31 illustrated in FIG. 11, the pixel circuit 30 may be modified so that the switching transistor T4 is inserted between the drive transistor TD and the power source line VDD.

Figure 12:
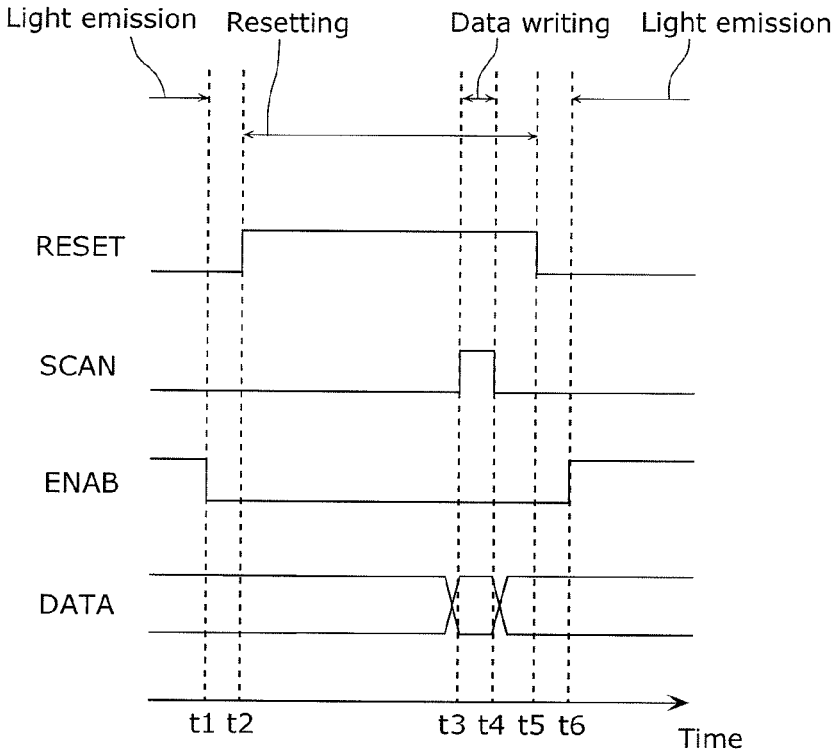
FIG. 12 is a timing chart illustrating an example of control signals and data signals in a modification of Embodiment 1.

FIG. 12 is a timing chart illustrating, over a 1-frame period, an example of the control signals and data signals for operating the pixel circuits 30 and 31. In FIG. 12, the vertical axis denotes the level of each signal, and the horizontal axis denotes time.

The operations of the pixel circuits 30 and 31 performed according to the control signals and data signals illustrated in FIG. 12 shall be described.

At a time t1, light emission in the preceding frame ends.

In a reset period from time t2 to t5, a reset operation is performed.

Through the entirety of the reset period, the switching transistor T3 is placed in the conducting state, and the reference voltage Vref, which is higher than a voltage obtained by adding the threshold voltage Vth to the positive power source voltage VDD, is applied to the gate terminal g of the driver transistor TD from the reference voltage line Vref. With this, the drive transistor TD is turned ON, and the reset operation is performed. At this time, since the switching transistor T4 is in the non-conducting state, the light emission of the organic EL element EL is inhibited.

In a data writing period from time t3 to t4, a data writing operation is performed. The data writing period overlaps with at least a part of the reset period, and the data writing operation is performed in parallel with the reset operation.

It should be noted that the data writing operation is performed sequentially on a row basis. As such, the data writing period for the row on which the data writing operation is performed first may start simultaneously with the reset period, at the time t2.

In the light emission period from the time t4 onward, a light-emitting operation is performed.

The data writing operation and the light-emitting operation are the same as the data writing operation and light-emitting operation described for the pixel circuit 10.

As in the pixel circuit 10, in the pixel circuits 30 and 31, the threshold voltage Vth of the drive transistor TD is set to approximately the same value in any frame due to the reset operation preceding the light-emitting operation, and thus the effect of threshold voltage change is eliminated, and it is possible to cause the organic EL element EL to emit light at a precise luminance corresponding to the data voltage Vdata.

With the pixel circuits 30 and 31, the reference voltage Vref can be applied to the gate terminal g of the driver transistor TD from the reference voltage line Vref through the entirety of the reset period. As such, unlike the pixel circuit 10, there is no concern about the reference voltage Vref changing due to a leak in the capacitor Cs, and a more reliable reset operation can be realized.

It should be noted that it is also acceptable to use the same signal as a signal line control signal SCAN for a control signal RESET, and perform the reset operation sequentially on a row basis only in the data writing period of the row. In such a case, the signal line RESET and the signal line SCAN may be realized by sharing the same signal line. Signal line sharing reduces the wiring area, and is thus useful in improving the arrangement density of the pixel circuits 30 and 31, and realizing a high-definition display device. Furthermore, since the number of outputs for the scanning line drive circuit 4 can be reduced, circuit size can be reduced and a reduction in cost can be realized.

Furthermore, the capacitor Csub need not be a capacitor formed in a dedicated region, and may be a parasitic capacitance located between a conductor included in the second terminal of the Capacitor Cs and a conductor included in the power source line VDD or the reference voltage line Vref or the signal lines SCAN and ENAB. Furthermore, the capacitor Csub may be the parasitic capacitance of the switching transistors T1 and T2.

Embodiment 2

Embodiment 2 of the present invention shall be described with reference to the drawings. In this embodiment, an example is shown for a display device in which a circuit for inhibiting the light emission of an organic EL element is provided outside the pixel circuit.

Figure 13:
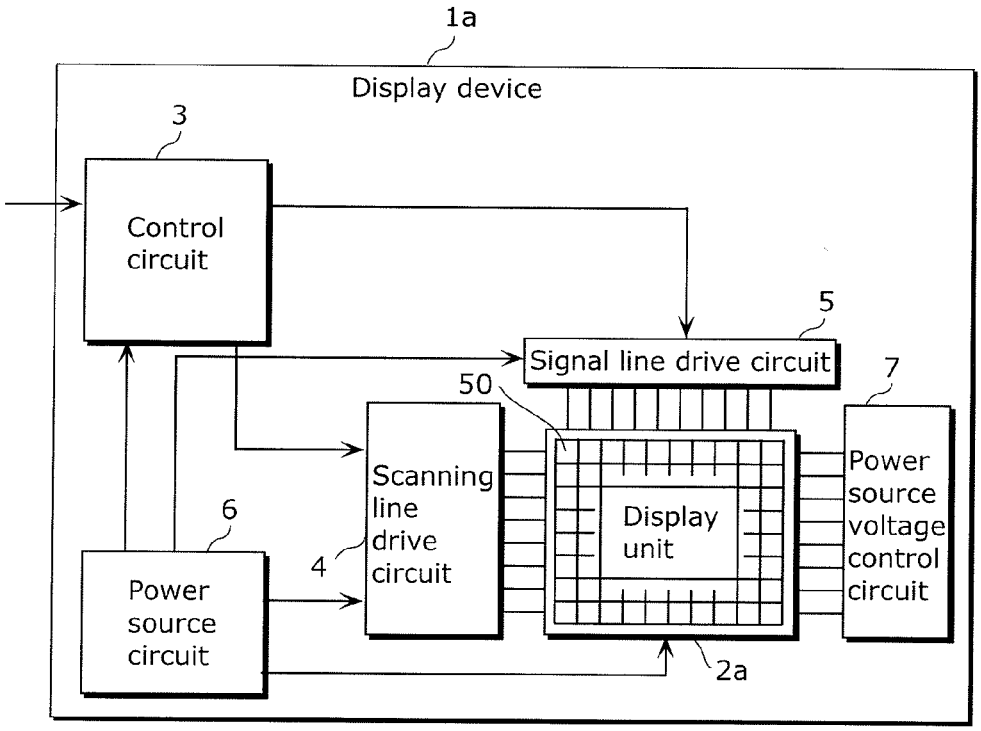
FIG. 13 is a function block diagram illustrating an example of a configuration of a display device in Embodiment 2.

FIG. 13 is a function block diagram illustrating an example of a configuration of a display device 1*a* in Embodiment 2.

Compared to the display device 1 in Embodiment 1, in the display device 1*a*, the display unit 2*a* is different and a power source voltage control circuit 7 is added.

The display unit 2*a* includes plural pixel circuits 50 which are arranged in a matrix. Each row in the matrix is provided with a scanning signal line and a power source line, and each column in the matrix is provided with a data signal line.

The power source voltage control circuit 7 is supplied with power to be used in the light emission by the organic EL element, from the power source circuit 6, and distributes the power-to the pixel circuits 50, on an independent row by row basis.

Figure 14:
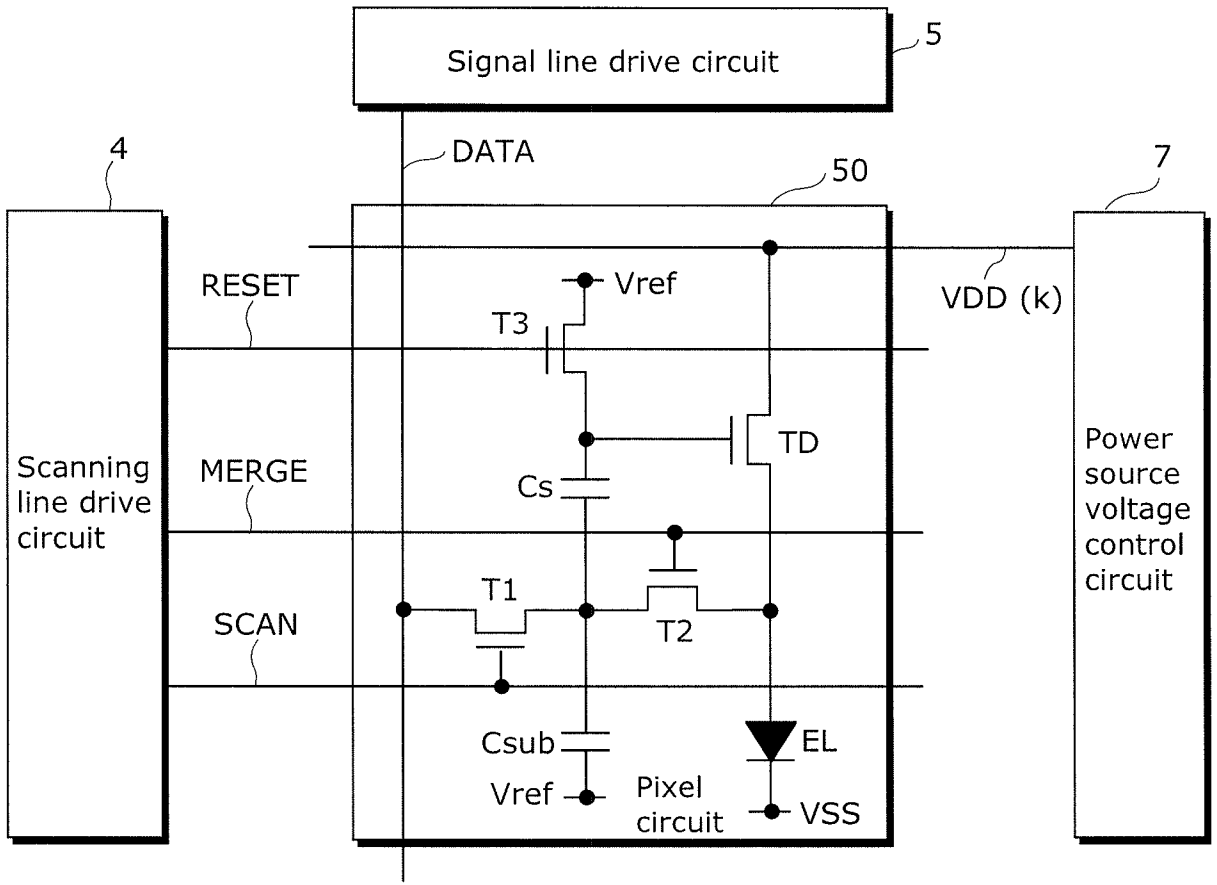
FIG. 14 is a circuit diagram illustrating an example of a configuration of a pixel circuit in Embodiment 2.

FIG. 14 is a circuit diagram illustrating an example of a configuration of the pixel circuit 50, and an example of the connections between the pixel circuit 50 and the scanning line drive circuit 4, the signal line drive circuit 5, and the power source voltage control circuit 7.

Each of the rows of the display unit 2*a* is provided with signal lines RESET, MERGE, and SCAN as scanning signal lines connected in common to the pixel circuits 50 provided in the same row. Each of the rows of the display unit 2*a* is additionally provided with a power source line VDD(k) connected in common to the pixel circuits 50 provided in the same row.

The signal line MERGE is the same as the signal line ENAB in the display unit 2. The power source line VDD(k) is an example of a first power source line, and corresponds to the power source line VDD in the display unit 2.

Compared to the pixel circuit 30 illustrated in FIG. 10, the pixel circuit 50 is different only in that the switching transistor T4 is omitted.

In the display device 1*a*, the function of inhibiting the light emission of the organic EL element EL is performed by the power source voltage control circuit 7. The power source voltage control circuit 7 outputs, to the power source line VDD(k), for example, the positive power source voltage VDD in a light emission period, and outputs, in a reset period, a low voltage (for example, the negative power source VSS) which is low enough that the organic EL element EL does not emit light. With this, the light emission of the organic EL element EL in the pixel circuits 50 connected to the power source line VDD(k) is inhibited in the reset period.

Furthermore, a voltage which is higher than a voltage obtained by adding the threshold voltage Vth to the voltage of a power source voltage VDD(k) in the reset period is used for the reference voltage Vref.

Figure 15:
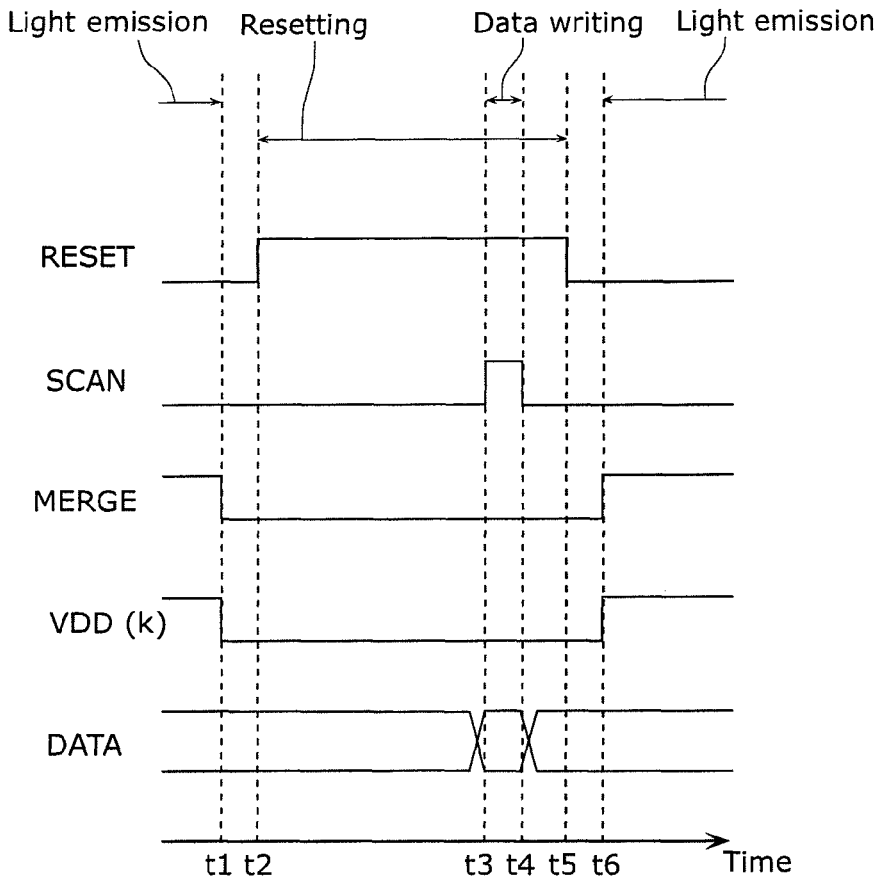
FIG. 15 is a timing chart illustrating an example of control signals, power source voltages, and data signals in Embodiment 2.

FIG. 15 is a timing chart illustrating, over a 1-frame period, an example of the control signals, power source voltage, and data signals for operating the pixel circuit 50. In FIG. 15, the vertical axis denotes the level of each signal, and the horizontal axis represents the passing of time. It should be noted that, for convenience of description, the voltage transmitted by the power source line VDD(k) is denoted as the power source voltage VDD(k). The HIGH level of the power source voltage VDD(k) is the positive power source voltage VDD, and the LOW level of the power source voltage VDD(k) is, for example, the negative power source voltage VSS.

Since the light emission of the organic EL element EL is inhibited in the period in which the power source voltage VDD(k) is in the LOW level, the operation of the pixel circuit 50 which is performed according to the control signals and power source voltage illustrated in FIG. 15 is equivalent to the operation of the pixel circuit 30 performed according to the control signals illustrated in FIG. 12.

It should be noted that the above-described pixel circuit 50 may be modified in the manner described below.

Figure 16:
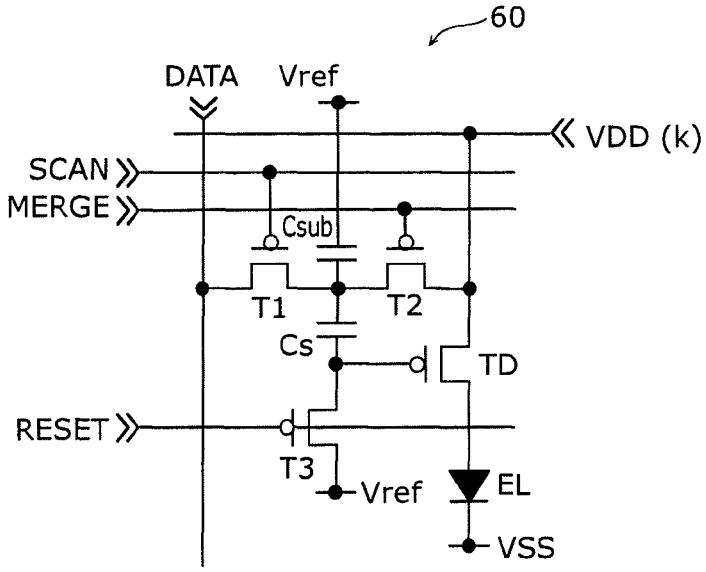
FIG. 16 is a circuit diagram illustrating an example of a configuration of a pixel circuit in Embodiment 2.

For example, as in a pixel circuit 60 illustrated in FIG. 16, the drive transistor TD and the switching transistors T1 to T4 may each be configured of a P-type transistor. The pixel circuit 60 performs the same operation as the pixel circuit 50 illustrated in FIG. 13 when provided with control signals and data signals having respective levels obtained by simply reversing the levels of the control signals and data signals used in the pixel circuit 50. Therefore, the same advantageous effect as with the circuit pixel 50 can be obtained with the pixel circuit 60.

Figure 17:
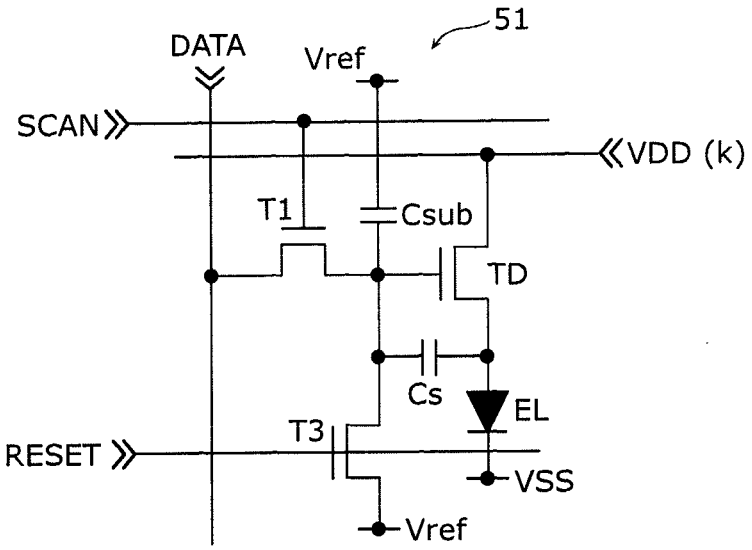
FIG. 17 is a circuit diagram illustrating an example of a configuration of a pixel circuit in Embodiment 2.
Figure 18:
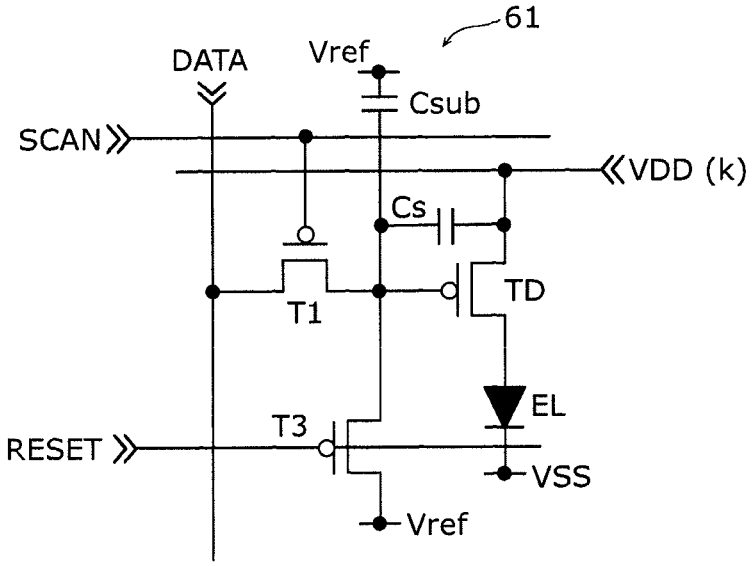
FIG. 18 is a circuit diagram illustrating an example of a configuration of a pixel circuit in Embodiment 2.

Furthermore, for example, as in a pixel circuit 51 illustrated in FIG. 17 and a pixel circuit 61 illustrated in FIG. 18, the switching transistor T2 may be omitted.

It should be noted that the drive transistors TD in the pixel circuits in the respective rows may be reset at different timings on a row basis, or the drive transistors TD in the pixel circuits in all of the rows may be collectively reset at the same timing.

The control method for collectively resetting all the drive transistors does not require controlling the power source voltage at different timings for each row, and thus can be executed not only by the display device 1*a* but also by a display device in which the power source lines VDD and VSS are connected in common to all of the pixel circuits as in the display device 1 described in Embodiment 1.

Although the display devices and methods of controlling the same according to the present invention are described using several embodiments and modifications, the present invention is not limited to such embodiments and modifications. Display devices and methods of controlling the same which are realized from various modifications of the exemplary embodiments as well arbitrary combinations of constituent components of the exemplary embodiments and modifications that may be conceived by those skilled in the art, for as long as these do not depart from the essence of the present invention, are intended to be included within the scope of the present invention.

Figure 19:
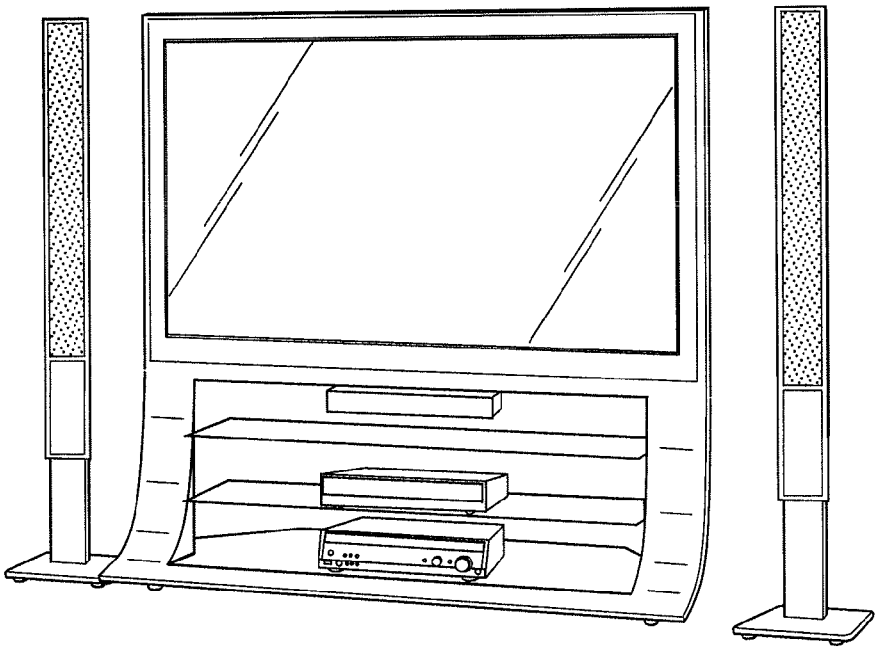
FIG. 19 is an external view of a thin flat-screen TV incorporating a display device according to the present invention.
Figure 20:
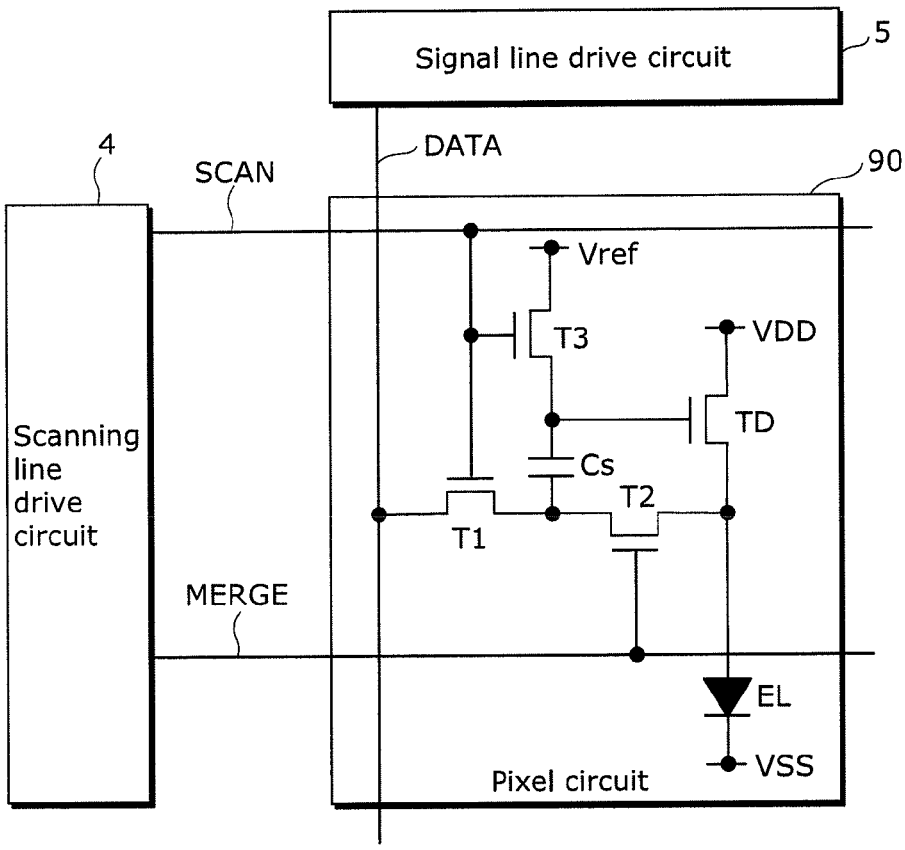
FIG. 20 Prior art
FIG. 20 is a circuit diagram illustrating an example of a configuration of a conventional pixel circuit.

A display device according to the present invention may be built into a thin flat-screen TV such as that illustrated in FIG. 19. A thin flat-screen TV capable of precisely displaying video represented by a video signal is implemented by having a display device according to the present invention built into the TV.

INDUSTRIAL APPLICABILITY

The present invention is useful in display device using organic EL elements, and is particularly useful in an active-matrix organic EL display device.

REFERENCE SIGNS LIST

1, 1*a* Display device
2, 2*a* Display unit
3 Control circuit
4 Scanning line drive circuit
5 Signal line drive circuit
6 Power source circuit
7 Power source voltage control circuit
10, 11, 20, 30, 31, 50, 51, 60, 61, 90 Pixel circuit
TD Drive transistor
T1, T2, T3, T4 Switching transistor
Cs Capacitor
EL Organic EL element

The invention claimed is:

1. A method of controlling a display device including a light-emitting element and a drive transistor which supplies current to the light-emitting element, the method comprising suppressing change in a threshold voltage of the drive transistor by applying a fixed forward bias voltage to a gate terminal of the drive transistor via a reference voltage line connected to the gate terminal and applying a fixed voltage from a power source line connected to one of a source terminal and a drain terminal of the drive transistor to an other of the source terminal and the drain terminal of the drive transistor; and holding a data voltage corresponding to light-emission luminance, in a capacitor including one terminal connected to the gate terminal of the drive transistor, wherein, in the suppressing, the fixed forward bias voltage is set so that a voltage across the gate terminal and the source terminal and a voltage across the gate terminal and the drain terminal of the drive transistor are each a voltage larger than the threshold voltage of the drive transistor, in the suppressing, a switch connected between the drive transistor and the light-emitting element is switched to a non-conducting state to inhibit light emission by the light-emitting element, and at least a part of the suppressing and a part of the holding are performed in parallel in a same period.

2. The method according to claim 1, wherein, in each of the power source line and a power source line for an electroluminescence common terminal, a voltage set in a light emission period and the fixed voltage set in the suppressing are equal.

3. A display device comprising a display including pixels, wherein each of the pixels includes:

a drive transistor including a source terminal and a drain terminal, one of the source terminal and the drain terminal being connected to a first power source line transmitting a first power source voltage;

a first capacitor including a first terminal connected to a gate terminal of the drive transistor;

a first switch which switches between conduction and non-conduction between a second terminal of the first capacitor and a data line transmitting a data voltage corresponding to luminance;

a second switch which switches between conduction and non-conduction between the second terminal of the first capacitor and the source terminal of the drive transistor;

a third switch which switches between conduction and non-conduction between the first terminal of the first capacitor and a reference voltage line transmitting a fixed reference voltage;

a light-emitting element including: a first terminal connected to an other of the source terminal and the drain terminal of the drive transistor; and a second terminal connected to a second power source line transmitting a second power source voltage; and a second capacitor including: a first terminal connected to the second terminal of the first capacitor; and a second terminal connected to one of the first power source line and the reference voltage line, wherein, when the third switch is in a conducting state: the fixed reference voltage is set to the gate terminal of the drive transistor so that a forward bias voltage larger than a threshold voltage of the drive transistor is applied across the gate terminal and the source terminal and across the gate terminal and the drain terminal of the drive transistor; and a fixed voltage from the first power source line connected to the one of the source terminal and the drain terminal of the drive transistor is set to the other of the source terminal and the drain terminal of the drive transistor, the fixed reference voltage and the fixed voltage being set for performing a reset operation to suppress change in the threshold voltage of the drive transistor, when the fixed reference voltage and the fixed voltage are set, a fourth switch connected between the drive transistor and the light-emitting element is switched to a non-conducting state to inhibit light emission by the light-emitting element, and a data voltage corresponding to light-emission luminance is held in the first capacitor, including the first terminal connected to the gate terminal of the drive transistor, in parallel in a same period during at least a part of the reset operation for suppressing the change in the threshold voltage of the drive transistor.

4. The display device according to claim 3, wherein a control line for controlling the first switch and a control line for controlling the third switch use a shared line, and a control line for controlling the second switch and a control line for controlling the fourth switch use a shared line.

5. The display device according to claim 3, further comprising a power source voltage control circuit which controls, on a pixel row basis, power source voltage transmitted by the first power source line.

6. The method according to claim 1, wherein, in the suppressing, a potential of the drain terminal of the drive transistor and a potential of the source terminal of the drive transistor are equal.

7. The display device according to claim 3, wherein, in a period in which the reset operation is performed, a potential of the drain terminal of the drive transistor and a potential of the source terminal of the drive transistor are equal.

8. The method according to claim 1, further comprising:

setting the switch connected between the drive transistor and the light-emitting element to the non-conduction state during the suppressing for inhibiting the light emission of the light-emitting element.

9. The method according to claim 6, wherein the potential of the drain terminal of the drive transistor and the potential of the source terminal of the drive transistor are equal to the fixed voltage from the power source line.

10. The display device according to claim 3, wherein light emission of the light-emitting element is inhibited when the fixed reference voltage and the fixed voltage are set.

11. The display device according to claim 7, wherein the potential of the drain terminal of the drive transistor and the potential of the source terminal of the drive transistor are equal to the fixed voltage from the power source line.

12. A display device comprising a display including pixels, wherein each of the pixels includes:

a drive transistor including a source terminal and a drain terminal, one of the source terminal and the drain terminal being connected to a first power source line transmitting a first power source voltage;

a first capacitor including a first terminal connected to a gate terminal of the drive transistor;

a first switch which switches between conduction and non-conduction between a second terminal of the first capacitor and a data line transmitting a data voltage corresponding to luminance;

a second switch which switches between conduction and non-conduction between the second terminal of the first capacitor and the source terminal of the drive transistor;

a third switch which switches between conduction and non-conduction between the first terminal of the first capacitor and a reference voltage line transmitting a fixed reference voltage;

a light-emitting element including: a first terminal connected to an other of the source terminal and the drain terminal of the drive transistor; and a second terminal connected to a second power source line transmitting a second power source voltage;

a fourth switch inserted in a path of current supplied from the drive transistor to the light-emitting element, the fourth switch switching between conduction and non-conduction in the path of the current; and a second capacitor including: a first terminal connected to the second terminal of the first capacitor; and a second terminal connected to one of the first power source line and the reference voltage line, wherein, when the third switch is in a conducting state, the fixed reference voltage is set so that a forward bias voltage larger than a threshold voltage of the drive transistor is applied across the gate terminal and the source terminal and across the gate terminal and the drain terminal of the drive transistor, a control line for controlling the first switch and a control line for controlling the third switch use a shared line, and a control line for controlling the second switch and a control line for controlling the fourth switch use a shared line.

* * * * *